United States Patent [19]

Hirano

[11] Patent Number: 4,720,868

[45] Date of Patent: Jan. 19, 1988

[54] DYNAMIC TRANSDUCER DEVICE

[75] Inventor: Mutsuo Hirano, Saitama, Japan

[73] Assignee: Sanden Corporation, Gunma, Japan

[21] Appl. No.: 768,341

[22] Filed: Aug. 22, 1985

[30] Foreign Application Priority Data

Sep. 3, 1984 [JP] Japan ..... 59-184197
Jan. 22, 1985 [JP] Japan ..... 60-6203[U]

[51] Int. Cl.[4] ..... H04R 1/24; H04R 9/00

[52] U.S. Cl. ..... 381/182; 381/194; 381/195; 381/199; 381/186

[58] Field of Search ..... 179/115.5 PS, 115.5 R, 179/115.5 PC, 117, 119 C, 180, 146 R, 146 E; 128/33; 381/90, 95, 96, 182, 194, 197, 199, 200, 201, 195, 186

[56] References Cited

U.S. PATENT DOCUMENTS 2,539,672 1/1951 Olson et al. ..... 381/184
4,064,376 12/1977 Yamada ..... 128/33
4,550,428 10/1985 Yanagishima et al. ..... 381/194
4,635,287 1/1987 Hirano ..... 381/154

FOREIGN PATENT DOCUMENTS 58-215200 12/1983 Japan ..... 179/115.5 R
2162718A 2/1986 United Kingdom ..... 179/115.5 R

*Primary Examiner*—Thomas W. Brown
*Assistant Examiner*—Danita R. Byrd
*Attorney, Agent, or Firm*—Hopgood, Calimafde, Kalil, Blaustein & Judlowe

[57] ABSTRACT

A dynamic speaker device having a small-sized vibrating plate for reproducing a high frequency sound is further provided with an additional coil in the vicinity of the magnet assembly of the speaker. The additional coil is mounted on a comparatively heavy vibrating element which is supported by a spring plate. The additional coil and the vibrating element vibrates to reproduce lower frequency sound and vibration in response to audio signal supplied to the additional coil.

18 Claims, 14 Drawing Figures

DYNAMIC TRANSDUCER DEVICE

BACKGROUND OF THE INVENTION (1) Field of the Invention

The present invention relates to dynamic transducer devices and, in particular, to a dynamic speaker device which is a small type but can reproduce a vibration of a frequency lower than about 250 Hz, more particularly about 100 Hz or less, as well as a higher frequency band.

(2) Description of the Prior Art

A known dynamic speaker comprises a magnetic assembly having a permanent magnet and a magnetic yoke with a magnetic gap. A voice coil is disposed in the magnetic gap. A vibrating plate of, usually, a cone shape is mechanically connected to the voice coil. The vibrating plate is elastically supported by spring means. When an audio signal is fed to the voice coil, the coil axially reciprocates according to the amplitude and frequency of the audio signal. Accordingly, the vibrating plate vibrates and reproduces the sound.

Generally speaking, a speaker having a vibrating plate of a small diameter cannot reproduce a low frequency sound or vibration because the vibrating amplitude is limited at the lower frequency.

In a known audio system, plural speakers of small and large diameter are often used together to cover the frequency range.

In another system which reproduces from an electric audio signal not only sound felt by ear but also vibration of, preferably, undertones lower than about 150 Hz to be directly transmitted to a body, an electromechanical vibrator is used for reproducing the mechnical vibration in addition to sound speakers, as disclosed in U.S. Pat. No. 4,064,376.

The use of two speakers of different sizes or the vibrator in addition to the speaker results in an increased size of an apparatus, device, or instrument to which they are assembled.

SUMMARY OF THE INVENTION

It is an object of the present invention to provide a dynamic transducer device which can reproduce vibration of a frequency band lower than about 250 Hz, especially 150 Hz or less, as well as sound of the higher frequency.

It is another object of the present invention to provide such a dynamic transducer device which is small in size and simple in construction and assembly.

As described above, a dynamic transducer device comprises a magnetic assembly having a permanent magnet and a magnetic yoke with a magnetic gap, and a voice coil disposed in the magnetic gap. According to the present invention, the dynamic transducer device further comprises an additional coil disposed in the vicinity of the magnetic assembly, a vibrating body mechanically connected to, and supporting, the additional coil, and support means elastically supporting the vibrating body.

According to one aspect of the present invention, the vibrating body is an annular magnetic coil housing, in which the additional coil is mounted.

According to another aspect of the present invention, a magnetic yoke is provided with an additional magnetic gap in which the additional coil is disposed. The vibrating body comprises an annular plate and a cylinder fixed thereon. The additional coil is mounted on the cylinder.

According to still another aspect, the support means comprises a support rod and a spring plate fixedly mounted thereon. The annular coil housing or the annular plate is joined to the spring plate at equiangularly-spaced positions.

In the present invention, since the additional coil is also disposed in the magnetic field generated by the permanent magnet, supply of the audio signal to the additional coil results in vibration of the additional coil. Accordingly, the vibrating body vibrates together with the additional coil.

In this construction, the lower frequency vibration can be generated from the vibrating body by the fact that the total amount of weight of the vibrating body, the spring plate, and the additional coil is designed to be comparatively large, and/or that the mechanical resistance and/or stiffness of the spring plate is selected to be comparatively large.

Further objects, features and other aspects will be understood from the following detailed description of preferred embodiments of the present invention with reference to the accompanying drawings.

DETAILED DESCRIPTION OF PREFERRED EMBODIMENTS

Figure 1:
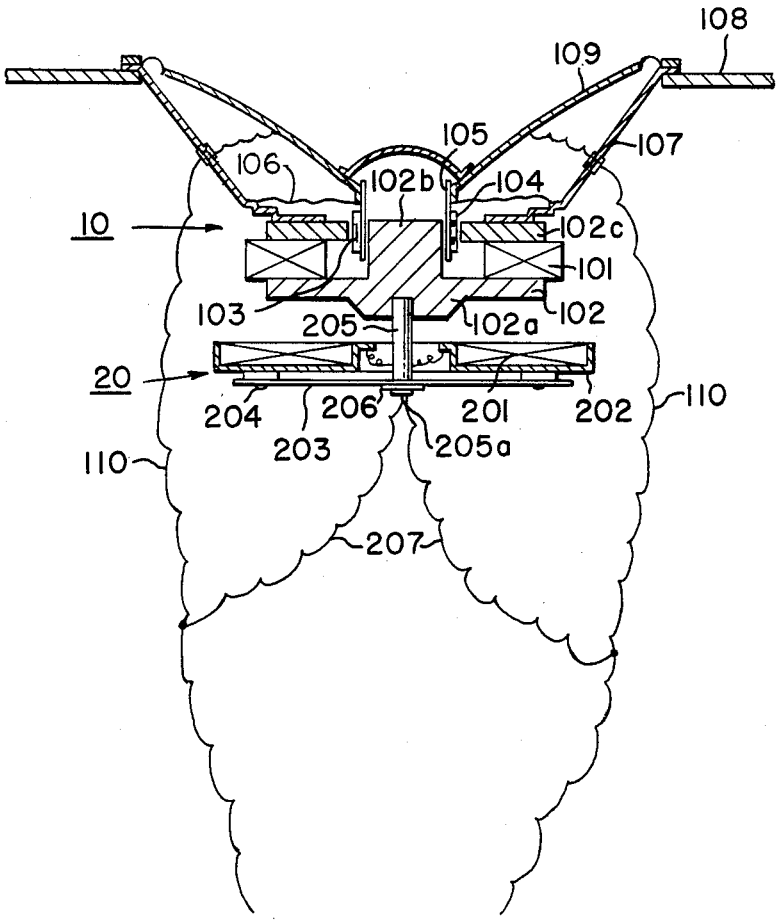
FIG. 1 is a sectional view of an embodiment of the present invention.

Referring to FIG. 1, a speaker device according to an embodiment of the present invention comprises a known speaker assembly 10 and an additional vibrating assembly 20.

Speaker assembly 10 includes a magnetic assembly comprising an annular permanent magnet 101 and a magnetic yoke 102. The magnetic yoke comprises a circular plate portion 102*a*, a center pole portion 102*b* mounted at the center of circular plate portion 102*a*, and an annular plate portion 102*c* having a center hole. Permanent magnet 101 is mounted on circular plate portion 102*a*, and annular plate portion 102*c* is mounted on permanent magnet 101. Center pole 102*b* extends through the center aperture in annular permanent magnet 101. The extended end of pole 102*b* is in the center hole of annular plate portion 102*c* with a small annular magnetic gap 103 remaining between the radially outer surface of the extended end and the radially inner surface of the central hole.

A voice coil 104 is disposed in magnetic gap 103, and is mounted on a cylindrical bobbin 105. Bobbin 105 is supported by a centering device or a spider 106 which is connected to a frame 107. Numeral 108 represents a baffle plate.

A vibrating plate, which is usually a cone 109, is supported at its outer periphery by frame 107, and is connected at its central portion to bobbin 105.

Voice coil 104 is connected to electric lead wires 110 which are connected to an amplifier (not shown) for supplying an audio signal.

The above-described arrangement is well known as a dynamic speaker. When an audio signal is supplied to voice coil 104 through lead wires 110, voice coil 104 reciprocates and drives vibrating plate 109 to reproduce sound as well known in the prior art.

In this connection, there is a relationship between the diameter of the vibrating plate 109 and the reproduceable frequency. The smaller the diameter is, the higher the reproduceable frequency generally is. Therefore, a speaker of small size generally cannot reproduce low frequency sound and vibration.

The present invention attempts to add an additional vibrating assembly to the known speaker assembly of small size so as to enable reproduction of low frequency sound and vibration.

According to the present invention, the embodiment of FIG. 1 is provided with the additional vibrating assembly 20. The vibrating assembly comprises an additional coil 201 having comparatively many turns. The additional coil is mounted in an annular magnetic coil housing 202. The coil housing has a "U" shape in cross-section and is made of iron to have comparatively great weight.

The additional coil 201 and coil housing 202 are disposed opposite to, and adjacent to, the back surface of circular plate portion 102*a* of speaker assembly 10.

Figure 2:
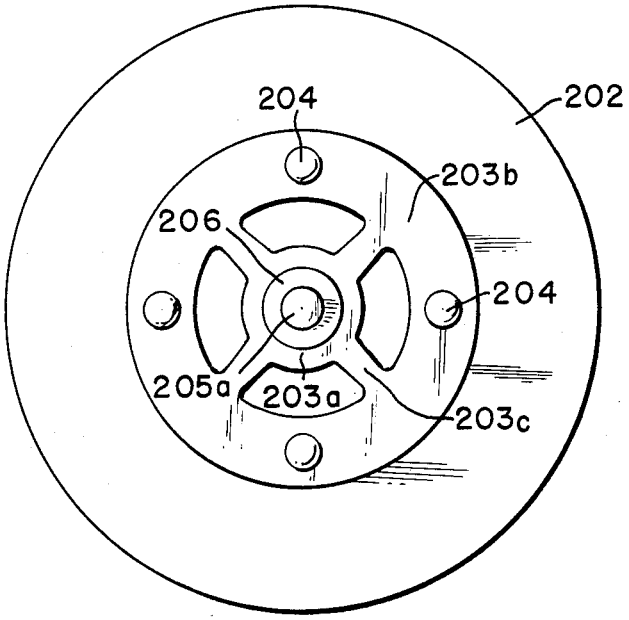
FIG. 2 is a rear view of a vibrating assembly of the embodiment.

A spring plate 203 of, for example, phosphor bronze is joined to the bottom of annular housing 202 at equiangular-spaced positions. The spring plate comprises a center circular plate 203*a*, a concentric outer annular plate 203*b*, and a plurality of radial beams 203*c*, as shown in FIG. 2. The radial beams bridge between the equiangularly-spaced positions of the outer margin of center circular plate 203*a* and the inner margin of outer annular plate 203*b* to connect the center plate 203*a* and outer annular plate 203*b* together. The outer annular plate 203*b* is joined to the bottom of the annular housing 202 at equiangularly-spaced positions by, for example, rivets 204.

The spring plate 203 is fixedly mounted on one end of a support rod 205. That is, central circular plate 203*a* has a central hole in which an end screw portion 205*a* of support rod 205 is inserted, with a nut 206 being fastened to screw portion 205*a*.

Support rod 205 extends through a hollow of annular coil housing 202, and the extended end is fixedly mounted to a center of the circular plate portion 102*a* of the magnetic yoke, so that the coil 201 is disposed adjacent the circular plate portion 102*a*.

Additional coil 201 is connected to lead wires 110 by its leads 207 so as to be in parallel with the voice coil 104.

Figure 3:
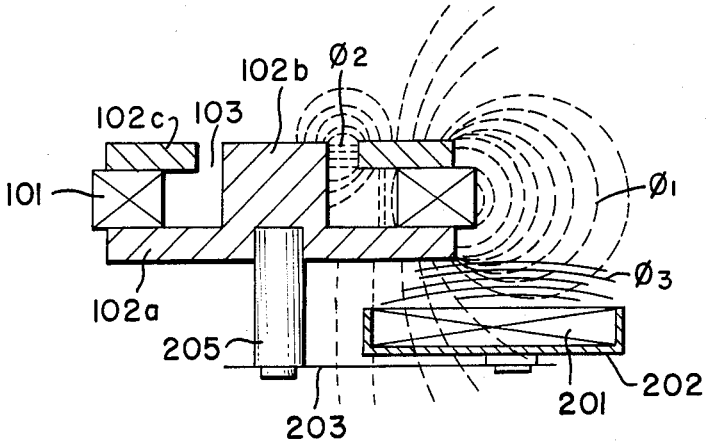
FIG. 3 is a sectional view of a main part of the embodiment, illustrating magnetic field generated by a permanent magnet in the embodiment.

According to the arrangement, additional coil 201 is within a magnetic field of magnetic fluxes $\phi_1$ leaking from magnetic assembly 101–102 of speaker assembly 10, as shown in FIG. 3. In the figure, $\phi_2$ represents magnetic fluxes produced in magnetic gap 103.

When the audio signal is applied to additional coil 201, the additional coil receives electromagnetic force to vibrate together with coil housing 202 and spring plate 203. $\phi_3$ is magnetic fluxes generated by electric current flowing through the additional coil.

Since the number of winding turns of the additional coil 201, the combined weight of additional coil 201, coil housing 202 and spring plate 203, and the stiffness of spring plate 203 are great in comparison with that of voice coil 104, cone 109 and spider 106 in speaker assembly 10, the additional coil and the coil housing vibrate at the lower frequency. Therefore, the lower frequency sound and vibration are reproduced by the vibrating assembly.

It is not necessary that the diameters of the coil 201 and coil housing 202 be made larger than the cone 109 of the speaker assembly.

Thus, the speaker device of small size of the present invention can reproduce low frequency sound and vibration as well as the higher frequency sound.

It is not necessary that the vibrating assembly 20 be directly mounted on the speaker assembly 10, but the former should be fixedly disposed adjacent to the latter so that the additional coil 201 is electromagnetically coupled to the magnetic assembly 101–102 of the speaker assembly.

Figure 4:
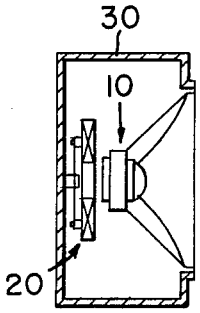
FIG. 4 is a sectional view of a modification of the embodiment.

Referring to FIG. 4, the vibrating assembly 20 is fixedly mounted within a speaker box 30 in which a speaker 10 is mounted. Thus, the vibrating assembly 20 is electromagnetically coupled to the speaker 10, and therefore, the lower frequency sound can be reproduced by the vibrating assembly.

Figure 5:
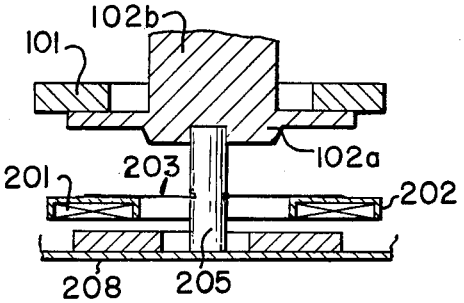
FIG. 5 is a sectional view of another embodiment of the present invention.

Referring to FIG. 5, a permanent magnet 208 can be additionally disposed adjacent to additional coil 201, so that the additional coil 201 is advantageously placed within a static magnetic field of an increased magnetic strength. As seen in the drawing, the spring plate 203, for supporting the coil housing 202 along with coil 201, is mounted on the support rod 205. The spring plate 203 is so mounted by joining it to the rod 205 about the radially outer surface of the rod.

The additional permanent magnet 208 is also mounted on support rod 205.

Figure 6:
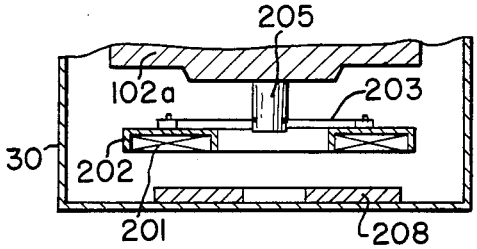
FIG. 6 is a sectional view of a modification of the embodiment of FIG. 5.

Referring to FIG. 6, the additional permanent magnet 208 can be fixedly mounted in speaker box 30 in which the speaker device with the vibrating assembly is mounted, as shown in the figure.

Figure 7:
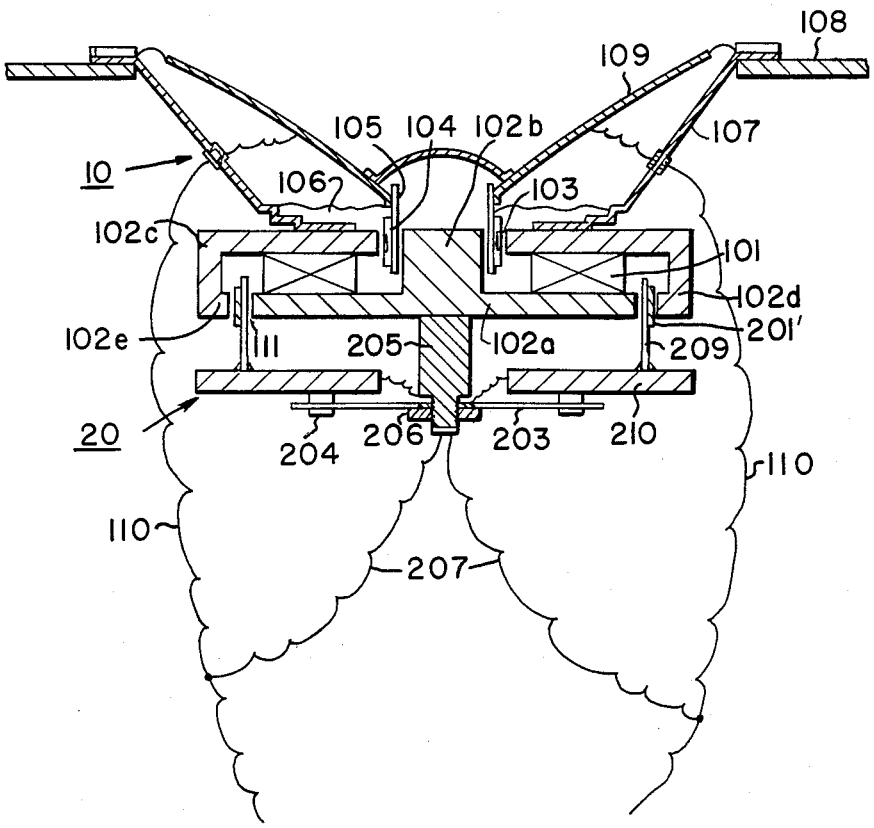
FIG. 7 is a sectional view of still another embodiment of the present invention.
Figure 8:
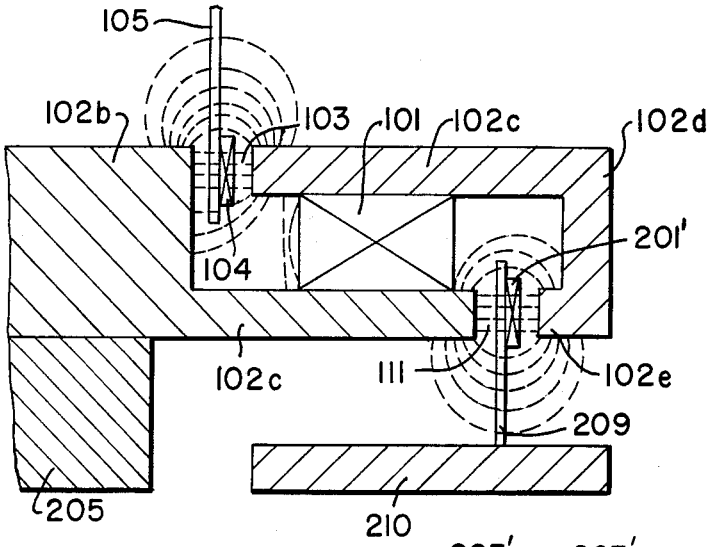
FIG. 8 is a sectional view of a main part of the embodiment of FIG. 7, illustrating magnetic field produced by a magnetic assembly in the embodiment of FIG. 7.

Referring to FIG. 7, another embodiment shown therein is generally similar to the embodiment of FIG. 1 but with a different arrangement for electromagnetically coupling the additional coil with the magnetic assembly in the speaker assembly.

Similar parts are represented by the same reference numerals as in FIG. 1 and detailed description thereof is omitted for the purpose of simplification of the description.

In this embodiment of FIG. 7, annular plate portion 102*c* of the magnetic yoke extends radially outwardly from its point of attachment to magnet 101, and the extended portion turns rearwardly towards plate portion 102*a*, as shown at 102*d*, and then radially inwardly to provide portion 102*e* which extends towards the radially outer margin of circular plate portion 102*a* of magnetic yoke 102 so as to form an additional annular magnetic gap 111 between the inner margin of the portion 102*e* and the outer margin of the circular plate portion 102*a*. Gap 111 is in addition to the previously described gap 103.

An additional coil 201' is formed in a shape similar to voice coil 104 i.e. annular. The additional coil 201' is fixedly mounted on a cylindrical bobbin or member 209 and is disposed in the additional magnetic gap 111.

Bobbin 209 is mounted coaxially on an annular vibrating plate element 210 which is made of, for example, iron and has a comparatively great weight.

Vibrating plate element 210 is joined to spring plate 203 by rivets 204 similar to FIGS. 1 and 2. The spring plate 203 is similarly supported on support rod 205 which is fixedly mounted on circular plate portion 102*a* of the magnetic yoke. Thus, in the embodiment of FIG. 7, the additional vibrating assembly 20 includes the coil 201', the bobbin 209, the annular plate 210, rivets 204 and the spring plate 203.

In the arrangement, magnetic fluxes flow through annular plate portion 102*c*, rearwardly directed portion 102*d*, inwardly directed portion 102*e*, additional magnetic gap 111, and circular plate portion 102*a*. Therefore, the additional coil 201' is exposed to a magnetic field of an increased strength. Accordingly, the vibrating amplitude of the coil 201' and vibrating plate element 210 is larger than that of the coil 201 and the coil housing 202 in FIG. 1 under the condition that equal current signals are applied to the respective coils 201' and 201.

Figure 9:
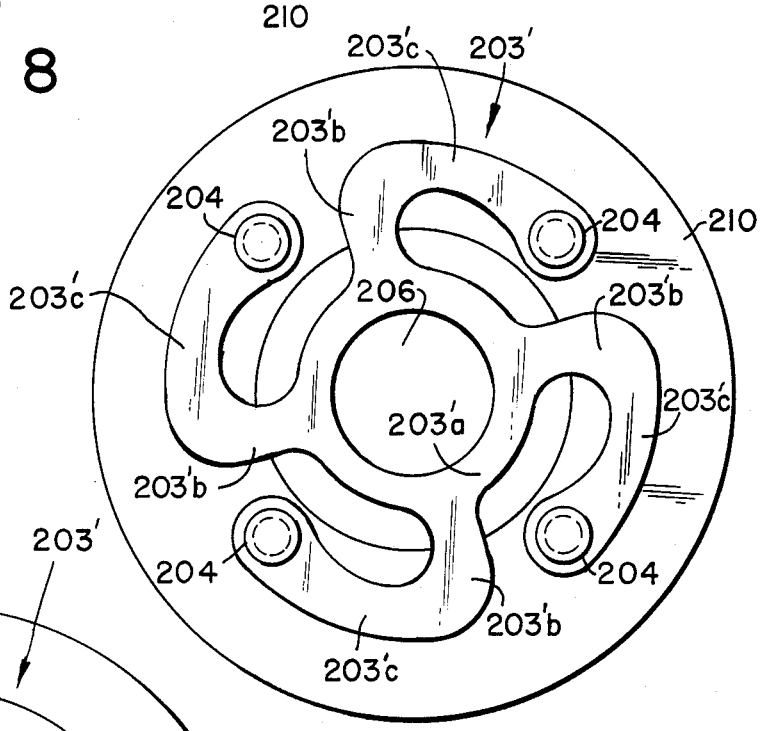
FIG. 9 is a rear view of the vibrating assembly in the embodiment of FIG. 7, but a different spring plate being used.

FIG. 9 shows another spring plate 203' which is used in place of spring plate 203 as shown in FIG. 2.

Referring to FIG. 9, the spring plate 203' comprises a central circular plate portion 203'*a* which is fixedly secured at the center to support rod 205 by nut 206. A plurality of fingers 203'*b* (four fingers are shown) extend outwardly from equiangularly-spaced positions on the outer periphery of the central circular plate portion 203'*a*. Fingers 203'*b* are further curved to extend concentrically as shown at 203'*c* in the figure, around central circular plate portion 203'*a*. The concentrically-extended ends are joined to vibrating plate element 210 by rivets 204 at equiangularly-spaced positions.

In this arrangement, the distance from the central circular plate portion 203*a* to rivet portion 204 along each finger is greater than the length of each beam 203*c* in FIG. 2. Therefore, the vibrating plate element 210 can smoothly vibrate at an increased amplitude, and the vibrating frequency band is enlarged.

Figure 10A:
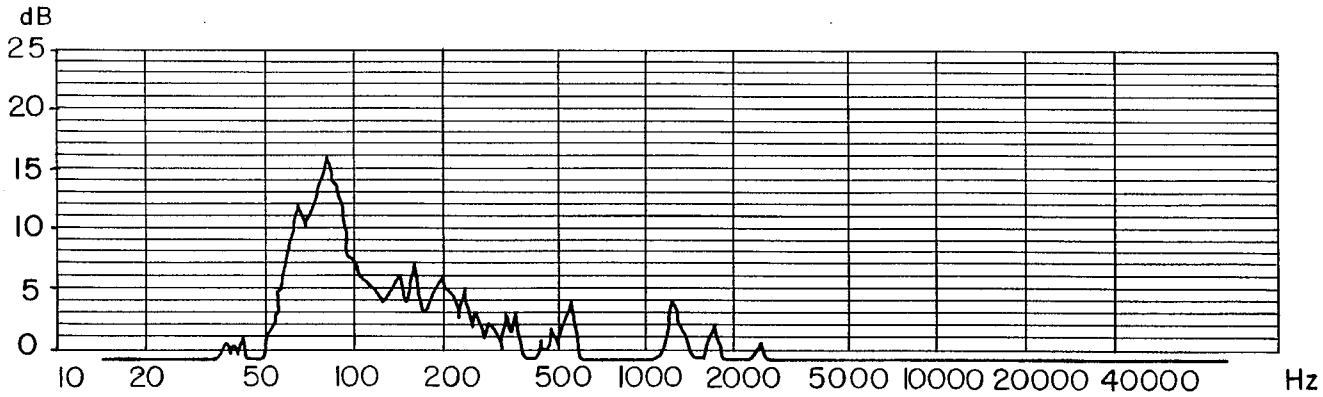
FIG. 10*a* is a view illustrating an output frequency response of the vibrating assembly in FIG. 7, for an input audio signal of 1 w.

An input signal of 1 W was applied to additional coil 201' in the device of FIG. 7 where the spring plate 203 of FIG. 2 is used. Frequency characteristic of the output vibration was measured as shown in FIG. 10*a*. It will be understood from FIG. 10*a*, that the output vibration is especially strong at a frequency of about 80 Hz.

Figure 10B:
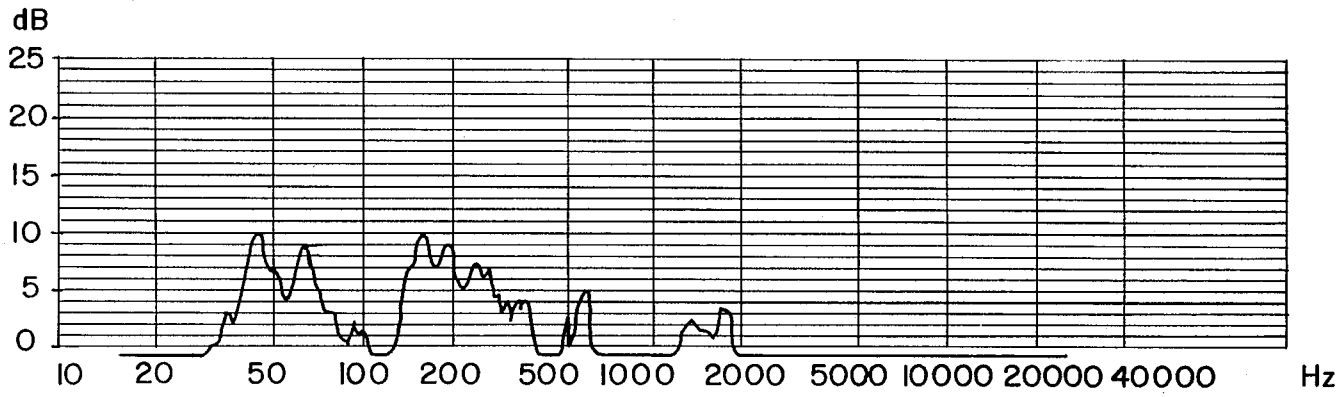
FIG. 10*b* is a view illustrating an output frequency response of the vibrating assembly in FIG. 9, for an input audio signal of 1 w.

The spring plate 203' of FIG. 9 was used in place of spring plate 203 and a frequency characteristic was measured. The measured data is shown in FIG. 10*b*. In this case, there are four peaks at about 45 Hz, 60 Hz, 170 Hz and 200 Hz, which have generally equal levels.

Figure 11A:
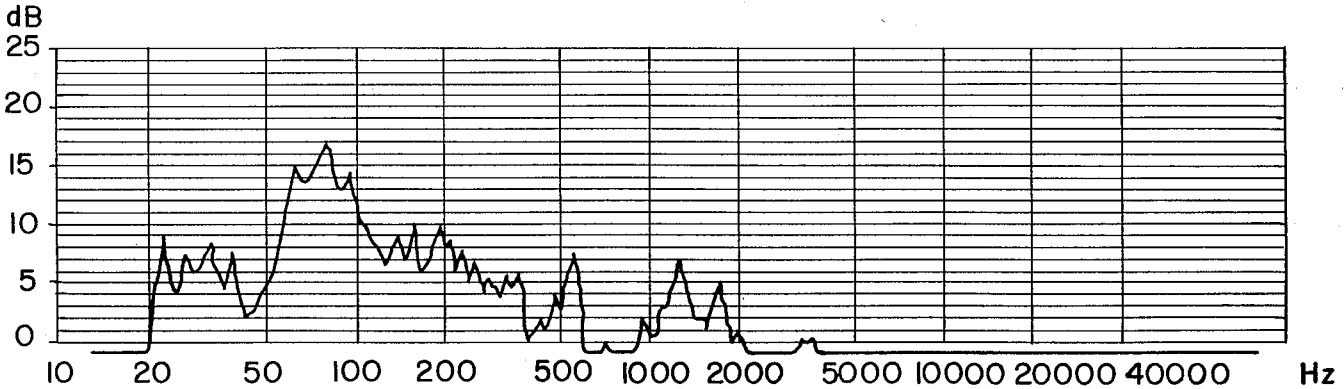
FIG. 11*a* is a view illustrating a frequency response similar to FIG. 10*a*, but for an input audio signal of 5 w.
Figure 11B:
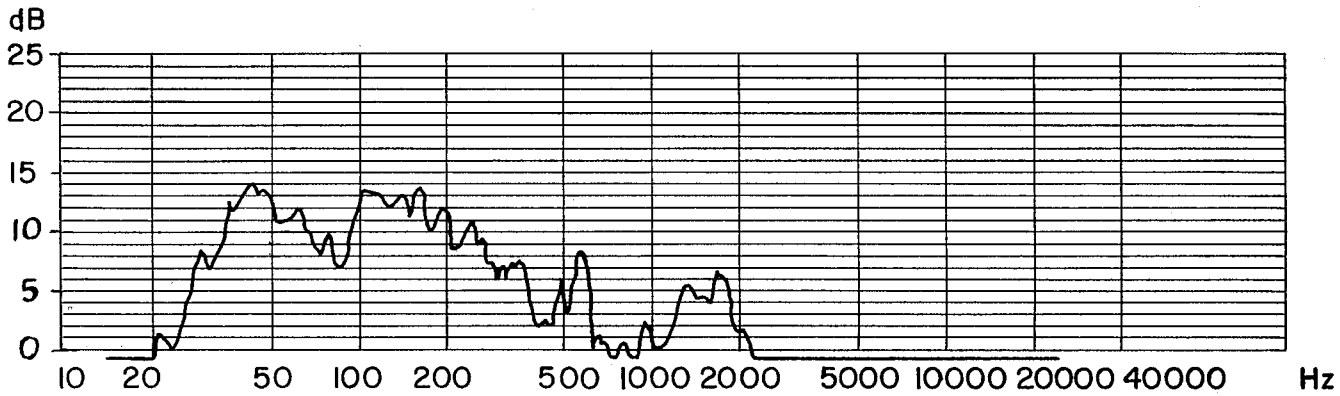
FIG. 11*b* is a view illustrating a frequency response similar to FIG. 10*b*, but for an input audio signal of 5 w.

For an increased input power of 5 W, the characteristic of FIG. 11*a* was obtained with use of the spring plate of FIG. 2, while the characteristic of FIG. 11*b* was observed with use of the spring plate of FIG. 9.

Comparing FIG. 11*a* and FIG. 11*b*, it will be understood that, although vibration at a frequency of 80 Hz is quite stronger than at other frequencies with use of the spring plate of FIG. 2, the use of the spring plate of FIG. 9 unifies the vibrating levels at various frequencies from about 30 Hz to about 250 Hz.

Figure 12:
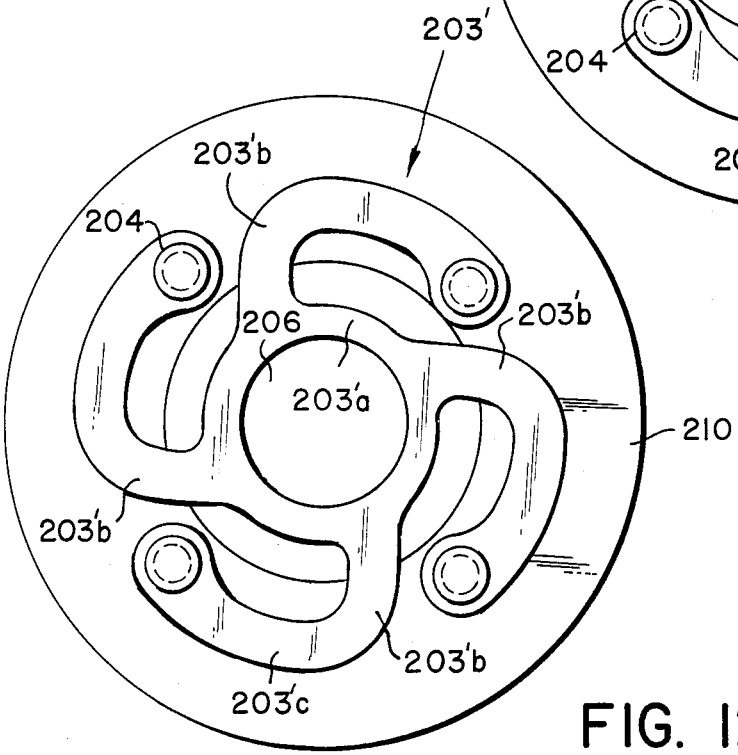
FIG. 12 is a rear view of a modification of FIG. 9.

Referring to FIG. 12, a modification of the spring plate of FIG. 9 is shown. In FIG. 9, each finger 203'*b* extends radially from central circular plate 203*a* along a diameter of the circular plate.

In comparison with this, each finger 203'*b* in FIG. 12 extends from the central circular plate 203'*a* along a chord of the circular plate offset from the diameter thereof. In the arrangement, the vibrating energy of fingers 203'*b* is distributed over the entire central circular plate 203'*a* without concentrating at the center thereof. As a result, the output vibration is more uniform over a wide frequency band.

It will be noted that the spring plates of FIGS. 9 and 12 can be used in the device of not only FIG. 7 but also FIG. 1.

Each spring plate of FIGS. 2, 9 and 12 is made of phosphor bronze, but it can be formed of a synthetic resin material reinforced by carbon fibers. For example, a molded cloth plate can be used wherein a carbon-fiber cloth is molded with synthetic resin such as epoxy resin. Alternatively, carbon fibers are mixed into plastic resin materials and the spring plate can be formed by injection molding.

What is claimed is:

1. A dynamic transducer device comprising in combination a magnetic assembly having a permanent magnet, a magnetic yoke with an annular magnetic gap, said yoke being coupled magnetically to said magnet, and a voice coil disposed in said magnetic gap; an additional coil of annular construction disposed in the vicinity of said magnetic assembly; an annular vibratile body having a central aperture, said additional coil being disposed coaxial with said annular vibratile body mechanically connected to and supported by said body, and support means elastically supporting said vibratile body, said support means comprising a support rod, means for mounting said support rod adjacent said magnetic assembly, and a spring plate fixedly mounted on said support rod, said annular vibratile body being connected to said spring plate at equiangularly-spaced positions.

2. The dynamic transducer device as claimed in claim 1, wherein said support rod extends through said central aperture of said annular vibratile body and has an extended end fixedly mounted on said magnetic yoke.

3. The dynamic transducer device as claimed in claim 2, wherein said magnetic yoke is provided with an additional annular magnetic gap, and said additional coil is disposed in said additional magnetic gap.

4. The dynamic transducer device as claimed in claim 3, wherein said magnetic yoke comprises a circular plate portion having a radially outer margin, a center pole mounted at the center of said circular plate portion and extending therefrom towards an end, and an annular plate portion having a central aperture and radially inner and outer margins; said center pole being in said central aperture so that said first mentioned annular gap is formed between the radially outer surface of said central pole and said inner margin of said annular plate portion, said annular plate portion having a portion that extends radially outwardly from said central aperture and turns towards said circular plate portion and then radially inwardly towards the radially outer margin of said circular plate portion thereby forming said additional annular magnetic gap between said outer margin of said circular plate portion and said radially inwardly directed portion.

5. The dynamic transducer device as claimed in claim 3, wherein said annular vibratile body comprises an annular plate and a coaxial cylindrical member with one end attached to said annular plate, said additional coil being mounted on the radially outer surface of said cylindrical member.

6. The dynamic transducer device as claimed in claim 1, wherein said annular vibratile body is an annular magnetic coil housing having a central aperture, and said additional coil is mounted within said coil housing.

7. The dynamic transducer device as claimed in claim 6, which further comprises an additional annular permanent magnet fixedly disposed adjacent said additional coil.

8. The dynamic transducer device as claimed in claim 6 or 7, wherein said support rod has an end mounted on said magnetic yoke and extends from said yoke through said central aperture of said coil housing.

9. The dynamic transducer device as claimed in claim 7, wherein said additional permanent magnet is coaxially and fixedly mounted on said support rod.

10. The dynamic transducer device as claimed in claim 9, wherein said support rod has an end fixedly mounted on said magnetic yoke and extends from said yoke towards an opposite end, said additional permanent magnet being supported on said opposite end of said support rod, and said spring plate being joined to said support rod about its radially outer surface.

11. The dynamic transducer device as claimed in claim 1, wherein said spring plate is made of phosphor bronze.

12. The dynamic transducer device as claimed in claim 1, wherein said spring plate is made of a synthetic resin plate reinforced by carbon fibers.

13. The dynamic transducer device as claimed in claim 1, wherein said vibratile body is made of iron.

14. The dynamic transducer device as claimed in claim 1, wherein said additional coil is electrically connected to said voice coil in parallel therewith.

15. The dynamic transducer device as claimed in claim 1, wherein said spring plate comprises a central circular plate element having a radially outer margin, a concentric outer annular plate element having a radially inner margin, and a plurality of equidistantly circumferentially spaced radial beam elements bridging between said outer margin of said central circular plate element and said inner margin of said outer annular plate element connecting the central and outer elements at equiangularly spaced positions, said outer annular plate element being secured to said annular vibratile body.

16. The dynamic transducer device as claimed in claim 1, wherein said spring plate comprises a central circular plate element having a radially outer margin, and a plurality of finger elements extending radially outwardly from equiangularly-spaced positions around said outer margin of said central circular plate element, said finger elements being curved to extend concentrically around said central circular element, and said fingers have respective ends attached to said annular vibratile body.

17. The dynamic transducer device as claimed in claim 16, wherein each of said finger elements extends radially from said central circular plate along a diameter of said circular plate, and then curves to extend concentric with said circular plate.

18. The dynamic transducer device as claimed in claim 16, wherein each of said finger elements extends from said central circular plate along a chord of said circular plate offset from the diameter thereof, and then curves to extend concentric with said circular plate.

* * * * *